United States Patent [19]

Curtis et al.

[11] Patent Number: 4,773,102

[45] Date of Patent: Sep. 27, 1988

[54] INNER-POCKETED TWO PERSON JACKET

[76] Inventors: Darryl A. Curtis; Alvener Curtis, both of 14229 Crescent Dr., Detroit, Mich. 48233

[21] Appl. No.: 145,290

[22] Filed: Jan. 19, 1988

[51] Int. Cl.[4] ..... A41D 1/02

[52] U.S. Cl. ..... 2/93; 2/69; 2/115; 2/102

[58] Field of Search ..... 2/108, 69, 69.5, 115, 2/93, 102, 97

[56] References Cited

U.S. PATENT DOCUMENTS 3,443,066 5/1969 Weibel ..... 2/69.5 X 3,523,302 8/1970 Rabedaux ..... 2/69.5

4,535,479 8/1985 Paula ..... 2/69.5

*Primary Examiner*—H. Hampton Hunter

*Attorney, Agent, or Firm*—Arnold S. Weintraub

[57] ABSTRACT

An outer garment to be worn by two persons together, consisting of a vest, two sleeves and two inner arm support compartments. The garment can be a closed vest having a means of access for the head at the top, or having a front opening extending from top to bottom, having a first section and a second section with a means of closure. The inner arm support compartments afford the wearers comfort and wearing versatility, while allowing the two wearers to maintin close physical contact.

13 Claims, 1 Drawing Sheet

Fig-1
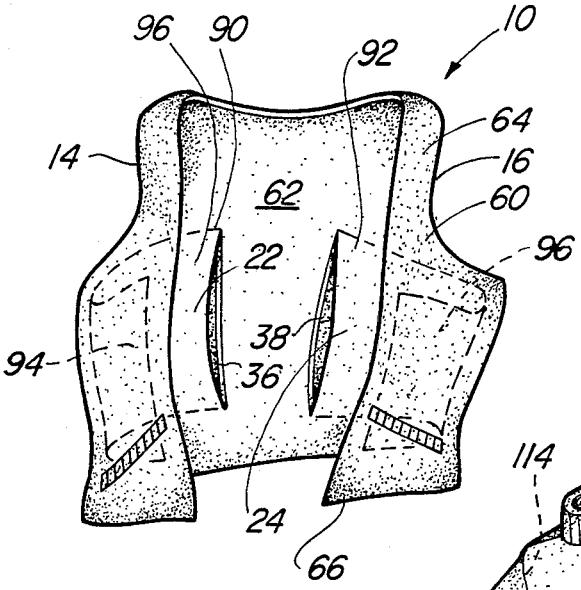
Fig-2
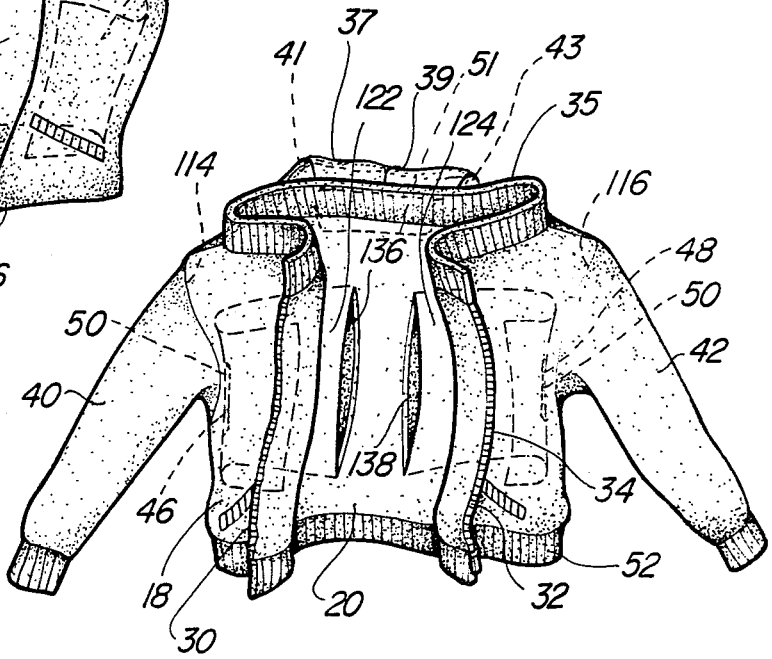
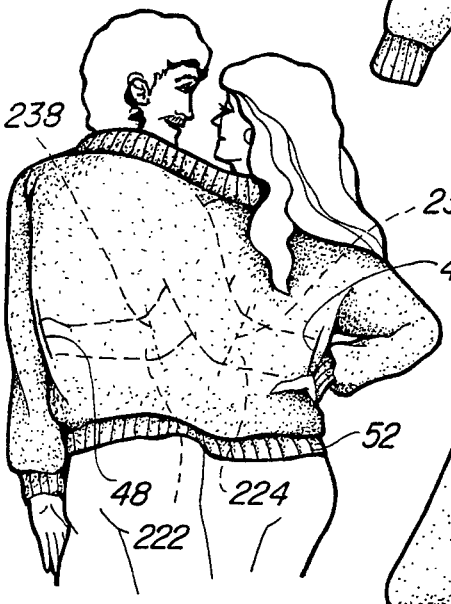
Fig-3
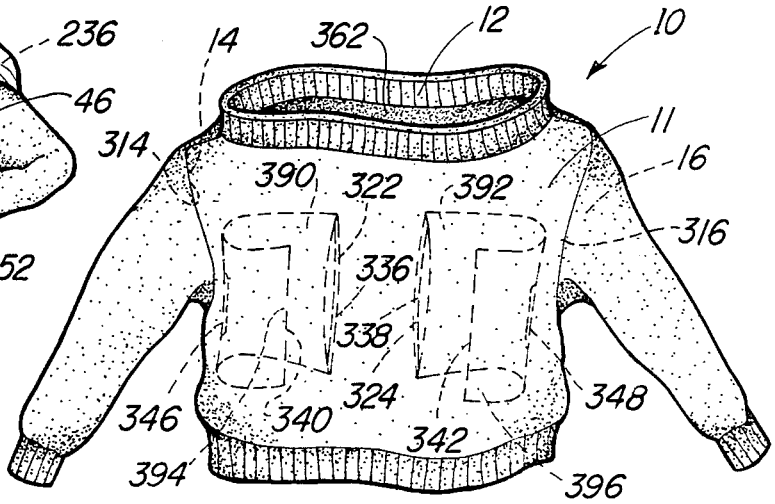
Fig-4

INNER-POCKETED TWO PERSON JACKET

BACKGROUND OF THE INVENTION

1. Field of the Invention:

The present invention concerns an outer garment to be worn in the manner of a coat, jacket, sweatshirt or sweater, made large enough to be worn by two or more people simultaneously.

2. Description of the Prior Art:

U.S. Pat. No. 560,961, entails a lap robe that may be worn by two or more persons having an enclosed spring to hold the robe close to those enclosed by the robe. U.S. Pat. No. 1,282,581 describes a lap robe that can be worn by one or more persons, having arm loops and straps to lighten the weight of the robe around the wearers' necks.

U.S. Pat. No. 12,170 describes a storm cloak to be worn by one or two occupants of an open automobile. The cloak can be adapted to fasten to the dashboard of the open automobile, or can be worn like a rain coat.

U.S. Pat. No. 3,443,066 describes a full length protective garment for outdoor use, having a heating element to provide additional warmth, to be worn by one or more persons.

U.S. Pat. No. 3,523,302 describes a full length outdoor coverall garment to be worn by one or more persons for protection from the elements.

U.S. Pat. No. 4,535,479 describes an outer garment to be worn by two persons simultaneously.

None of the above provide a garment for long term wear that preserves body warmth, enables relatively free movement and mobility of the wearers and provides internal arm supports.

SUMMARY OF THE INVENTION

The present invention is a garment which comprises:

(a) a vest having a front portion and a back portion, and an upper portion and a lower portion, the vest being capable of enwrapping the upper body of a first person and a second person, the vest having a right arm hole and a left arm hole;

(b) a left inner arm support member affixed to the inside of the vest along the back portion, the member having a near side and a far side, the arm support member having an opening at the near side of the member to enable insertion of the left arm of the first person; and (c) a right inner arm support member affixed to the inside of the vest along the back portion, the member having a near side and a far side, and having an opening at the near side of the member to enable insertion of the right arm of the second person.

The garment has a single opening for the heads of both wearers. The garment may be continuous such as a closed sweatshirt, or it may have a front opening to allow access into the garment. The garment comprises a first section and a second section with a means of fastening the first section to the second section. The arm openings may be sleeveless or have sleeves. The garment may be unhooded or hooded and the hood may be permanent or detachable. The collar may comprise a compartment for the purpose of enclosing the hoods.

BRIEF DESCRIPTION OF THE DRAWING

FIG. 1 is a front view of a vest with arm supports constructed in accordance with the present invention;

FIG. 2 is a front view of a jacket with arm supports constructed in accordance with the present invention;

FIG. 3 is a rear elevational view of two people wearing the garment described in FIG. 2 with arms positioned in the right and left arm supports; and FIG. 4 is a pullover garment constructed in accordance with the present invention.

DETAILED DESCRIPTION OF THE PREFERRED EMBODIMENTS

As hereinabove stated the preferred embodiment of the vest, is shown in FIG. 1 and generally, comprises:

(a) a vest 10 having a front portion 60 and a back portion 62, and an upper portion 64 and a lower portion 66, the vest being capable of enwrapping the upper body of a first person and a second person, the vest having a right arm hole 14 and a left arm hole 16;

(b) a left inner arm support member 24 affixed to the inside of the vest along the back portion 62, the member having a near side 92 and a far side 96, the member having an opening 38 at the near side of the member to enable insertion of the left arm of the first person; and (c) a right inner arm support member 22 affixed to the inside of the vest along the back portion 62, the member having a near side 90 and a far side 94, and having an opening 36 at the near side of the member to enable insertion of the right arm of the second person.

With more particularity, FIG. 2 illustrates the preferred embodiment which is a hooded garment comprising of a vest having a front portion 18 and a back portion 20. The vest has a right arm hole 14 and a left arm hole 16 to which sleeves are attached 40, 42. The vest has an opening with a first section 30 and a second section 32 and a means of securing the first section to the second section 34 such as but not limited to a zipper, snaps or Velcro ®. The garment is provided with the right and left arm supports 122, 124 located at the back portion 20 of the vest. Each support member as has open seam 136, 138 on the near side of the member for insertion of the arm and an opening on the far side of the member 40, 42. The garment has slits 46, 48 below the left and right sleeves through which the wearers may extend the arms to the exterior of the garment. The slits may be closed by some means 50, for example but not limited to zippers, snaps or Velcro ®. The garment has a collar 35 and one or more hoods attached 37, 39 with drawstrings 41, 43 for drawing the hoods close to the face. The collar may embody a compartment 51 for storage of the hood(s) not being worn. The waistband 52 is made of knit material to draw the waistband close to the bodies of the wearers.

FIG. 3 shows a rear elevational view of two people wearing the garment described in FIG. 2 with the wearers' arms inserted through the right and left arm support openings 236, 238 and positioned in the right and left arm support members 222, 224.

Shown in FIG. 4 is an embodiment consisting of a body 10 of fabric large enough to surround two persons in one wrap. The body 10 is a closed vest 11 with a single opening 12 which is wide enough to accommodate the neck and head of two persons, and right and left arm openings 14, 16 at the right most and left most upper extremes of the body 10.

Two inner arm support members 322, 324 are located in the middle of the back portion 362 of the vest. Each support member has an opening 336, 338 on the near sides of the members 390, 392 for insertion of an arm of a user. Each support member has an open seam 340, 342 at the far side, so the arm of the user may extend through the member.

To wear the garment, the two persons are side by side, each inserting his or her head through the neck access or opening 12, the person on the right extending his/or her right arm through the right arm opening 314 and the person on the left extending his/ or her left arm through the left arm opening 316. The other arms are inside the garment. The person on the right may insert the left arm into the left arm support opening 322 and the person on the left may insert the right arm into the right arm support opening 324. The wearers then extend the inner arms through the open seams 340, 342 at the far sides of the members 394, 396. The wearers can then extend the arms to the exterior of the garment through the right and left slits located below the right and left arm holes 346, 348.

The two person garment with arm supports provides added comfort and adaptability for the wearer not found in the prior art. The arm supports make the garment more comfortable and prevents fatigue by allowing each wearer to place his or her arm in any of several positions while supporting the arm. Each person may change the arm position independent of the position of the other person, through means of the support member.

The garment is adaptable, as the contact arm may encircle the other person while inside or outside the support member. A slit in the garment allows access to the exterior of the garment whether the arm is in or out of the support member. For warmth the hand may remain inside the support member. For additional warmth the arm support may be made of an insulated material and the slit to the exterior of the garment may be closed by a fastening means.

The garment allows two people to be close to each other and in contact with each other while preventing the escape of thermal energy. The garment can be worn by couples of all ages to any outdoor event. It is ideal for walks, sporting events, picnics, concerts, campfires, or the beach. The arm supports provide the wearers greater comfort and accommodation while enjoying the closeness the garment allows.

We claim:

1. A garment, which comprises:

(a) a vest having a front portion and a back portion and an upper portion and a lower portion, the vest being capable of enwrapping the upper body of a first person and a second person, the vest having a right arm hole and a left arm hole;

(b) a left inner arm support member affixed to the inside of the vest along the back portion, the member having a near side and a far side, the arm support member having an opening at the near side of the member to enable insertion of the left arm of the first person;

(c) a right inner arm support member affixed to the inside of the vest along the back portion, the member having a near side and a far side, and having an opening at the near side of the member to enable insertion of the right arm of the second person.

2. The garment of claim 1 further comprising:

(a) a collar attached to the upper portion of the vest;

(b) at least one hood attached to the collar.

3. The garment of claim 1 wherein there is a first open seam in the far side of the right support member of the vest and a second open seam in the far side of the left arm support member.

4. The garment of claim 1 further comprising: a left sleeve attached to the left arm hole and a right sleeve attached to the right arm hole, the right sleeve enwrapping the right arm of the first person, and the left sleeve enwrapping the left arm of the second person.

5. The garment of claim 1 wherein the vest has a right slit under the right arm hole of the vest and a left slit under the left arm hole of the vest.

6. The garment of claim 1 wherein, the vest has an opening, the opening having a first section and a second section extending along the front portion of the vest.

7. The garment of claim 6 further comprising: a means of securing the first section to the second section.

8. The garment of claim 2 wherein a compartment is located inside the collar, within which the hoods may be secured.

9. The garment of claim 1 wherein a waistband is attached to the lower portion of the vest.

10. A garment, which comprises:

(a) a vest having a front portion and a back portion, the vest being capable of enwrapping the upper body of a first person and a second person, the vest having a right arm hole and a left arm hole;

(b) an arm support member affixed to the inside of the vest along the back portion, the member having a middle section, a left side and a right side, the support member having an opening on the right side and an opening on the left side near the middle of the back portion to allow insertion of the right arm of the second person and the left arm of the first person, and the support members also having an open seam at the far end of the right support member and an open seam at the far end of the left arm support member; and (c) a right slit under the right arm hole and a left slit under the left arm hole of the vest.

11. The garment of claim 10 further comprising:

a right sleeve and a left sleeve, the right sleeve attached to the right arm hole, and the left sleeve attached to the left arm hole.

12. The garment of claim 10 further comprising:

(a) a collar attached to the upper portion of the vest; and (b) at least one hood attached to the collar of the vest.

13. The garment of claim 12 wherein a compartment is located within the collar, within which the hood or hoods may be secured.

* * * * *